United States Patent [19]

Ryder

[11] 4,154,354

[45] May 15, 1979

[54] SAFETY CONTAINER CLOSURES

[75] Inventor: Geoffrey A. Ryder, 17 Brownsfields, Welwyn Garden City, Hertfordshire, England, AL7 1AN

[73] Assignees: Trevor Gwilym Evans; Geoffrey Alan Ryder; Lyn Trevor Evans, all of Hertfordshire, England

[21] Appl. No.: 890,938

[22] Filed: Mar. 28, 1978

[30] Foreign Application Priority Data

May 10, 1977 [GB] United Kingdom ..... 19544/77

[51] Int. Cl.[2] ..... B65D 55/02; B65D 85/56

[52] U.S. Cl. ..... 215/216; 215/330

[58] Field of Search ..... 215/214, 216, 217, 330, 215/301

[56] References Cited

U.S. PATENT DOCUMENTS 3,704,802 12/1972 Schultz ..... 215/214

3,989,152 11/1976 Julian ..... 215/216

*Primary Examiner*—George T. Hall

*Attorney, Agent, or Firm*—Larson, Taylor and Hinds

[57] ABSTRACT

A child-resistant closure cap for fitting to an externally screw-threaded neck of a bottle is formed as a single integral injection moulding, preferably of polypropylene, forming an internally screw-threaded skirt, a bowed top wall which closes the top of the skirt, a force-applying member on the upper face of the top wall and lugs around the periphery of the underside of the top wall. The top wall is movable for snap action by the application to it of a force through the force-applying member between an upwardly bowed position and a downwardly bowed position. When the top wall is in the downwardly bowed position, the lugs engage with inward projections on the inside of the neck of the bottle and this prevents the closure cap from being unscrewed from the bottle. When the top wall is snapped into its upwardly bowed position, the lugs are moved clear of the inward projections and the cap can then be unscrewed.

10 Claims, 5 Drawing Figures

SAFETY CONTAINER CLOSURES

This invention relates to safety closure caps, which are child-resistant, for fitting to an externally screw-threaded neck or side wall of a container to close the container.

There are various forms of closure cap which are constructed in such a way that opening of the cap is not a straightforward operation and therefore makes it difficult for a young child to carry out. One such cap, which is disclosed in U.S. Pat. No. 3,698,584, comprises a single integral injection moulding of thermoplastic plastics material forming an internally screw-threaded skirt, a top wall which closes the top of the skirt and a locking part which is movable upwardly and downwardly with a snap action between a lower position in which engaging means carried by the locking part engages with projections on the container and prevents unscrewing of the cap, and an upper position in which the engaging means are clear of the projections to permit the cap to be unscrewed.

In the cap disclosed in the above-mentioned United States Specification, the locking part is in the form of a ring which surrounds the lower edge of the skirt and is connected to the bottom of the skirt by a number of angularly spaced integrally moulded strips of the plastics material. These strips are hinged both to the bottom of the skirt and to the ring and this enables the ring to be moved upwards and downwards relatively to the skirt. The ring has a number of radially inwardly projecting teeth which, when the ring is in its lower position engage with teeth provided around the bottom of the neck of a bottle onto which the cap is screwed and this inter-engagement prevents the cap from being unscrewed.

This form of cap is simple and relatively inexpensive to manufacture since it consists of a single integral injection moulding of thermoplastic plastics material, but its degree of resistance to opening by young children is not entirely adequate.

Thus, although it may not be apparent to a young child that it is necessary to lift the locking ring before it is possible to unscrew the cap, there is a tendency, if a young child plays with the cap when it is screwed on to a bottle, for the child inadvertently to lift the locking ring so that it snaps into its upper position and the child can then quite easily unscrew the cap and gain access to its contents. Particularly if a young child puts the cap into its mouth, then the locking ring can easily be pulled by the child's teeth into its upper unlocked position.

The aim of the present invention is to provide a safety closure cap which comprises a single integral injection moulding forming an internally screw-threaded skirt, a top wall and a locking part as described above, wherein the locking part is so disposed that the risk of it being moved inadvertently by a young child into its upper unlocked position is greatly reduced, that is to say the child resistance of the cap is enhanced.

To this end, according to this invention, a safety closure cap for fitting to an externally screw-threaded neck or side wall of a container to close the container comprises a single integral injection moulding of resilient thermoplastic plastics material forming an internally screw-threaded skirt and a bowed top wall which closes the top of the skirt and is movable with a snap action by the application of an upward or downward force between an upwardly bowed position and a downwardly bowed position, the top wall having on its upper face a force-applying member enabling the force to be applied to it and having around its periphery engaging means which, when the cap is screwed on to a container and the top wall is in its downwardly bowed position, engage with inward projections on the inside of the neck or side wall of the container and prevent unscrewing of the cap and, when the top wall is in its upwardly bowed position, the engaging means are clear of the projections to allow the cap to be unscrewed.

By using the top wall of the cap to form the upwardly and downwardly movable locking part in this way, the complexity of the operation of moving the locking part into its upper unlocked position can be made such that it is beyond the capability of a young child to move it either intentionally or inadvertently.

Whilst it is a simple matter to apply pressure to the top wall to move it from its upwardly bowed position into its downwardly bowed position, it is impossible to apply an upward force to the wall to move it into its upwardly bowed unlocked position other than by means of the force-applying member. The force-applying member may be constructed in such a way as to make the application of the necessary upward force to the top wall as difficult as may be required.

To enable the top wall to move with a positive snap action between its upwardly bowed position and its downwardly bowed position, the top wall preferably incorporates two concentric annular hinges which are formed by thin sections of the resilient plastics material. For durability, the cap is then preferably injection moulded out of polypropylene as it is well known that thin sections of polypropylene can be flexed repeatedly to form hinges without fracturing.

The top wall may comprise an annular peripheral portion which is horizontal, this portion being connected by an outer annular hinge to a further annular portion which extends at an upward inclination in a radially inward direction when the top wall is upwardly bowed and at a downward inclination in a radially inward direction when the top wall is downwardly bowed. The further annular portion is connected by the second annular hinge to a centre portion which closes the space within the second annular hinge and the force-applying member is then connected to the centre portion.

To ensure that the force-applying member cannot easily be gripped by a young child, even by the child's teeth if the child pushes the cap into its mouth, the force-applying member preferably comprises an outwardly projecting flange which is connected by an upright web to the centre portion of the top wall. The length of the web and the shape of the flange are such that when the top wall is in its downwardly bowed position, part of the periphery of the flange is closely adjacent the annular peripheral portion of the top wall and a remaining part of the periphery of the flange is in contact with the annular peripheral portion. The web is preferably resilient and flexible and then, in order to apply an upward force to the top wall to move it from its downwardly bowed position to its upwardly bowed position, downward pressure may be applied to a part of the flange diametrically opposite the part which is in contact with the annular peripheral portion of the top wall and this causes the flange to tilt so that the remaining part moves out of contact with the annular peripheral portion of the top wall. A finger can then be inserted under the remaining part of the flange to lift the top wall into its upwardly bowed position.

The invention also consists, according to another of its aspects, in the combination of a closure cap in accordance with the invention with a container having an externally screw-threaded neck or side wall on to which the cap is screwed. The neck or side wall of the container has on its inside inward projections with which the engaging means of the cap engage when the top wall is in its downwardly bowed position.

The engaging means preferably comprises a series of circumferentially spaced lugs which move downwards and radially outwards as the top wall is moved from its upwardly bowed to its downwardly bowed position. The inward projections on the neck or side wall of the container are preferably in the form of ratchet teeth with sloping upper edges. This combination of lugs and ratchet teeth enables the cap to be screwed on to the container while the top is in its downwardly bowed position without damaging the closure cap.

An example of a closure cap, and of the closure cap in combination with a container, in accordance with the invention, are illustrated in the accompanying drawings, in which.

Figure 1:
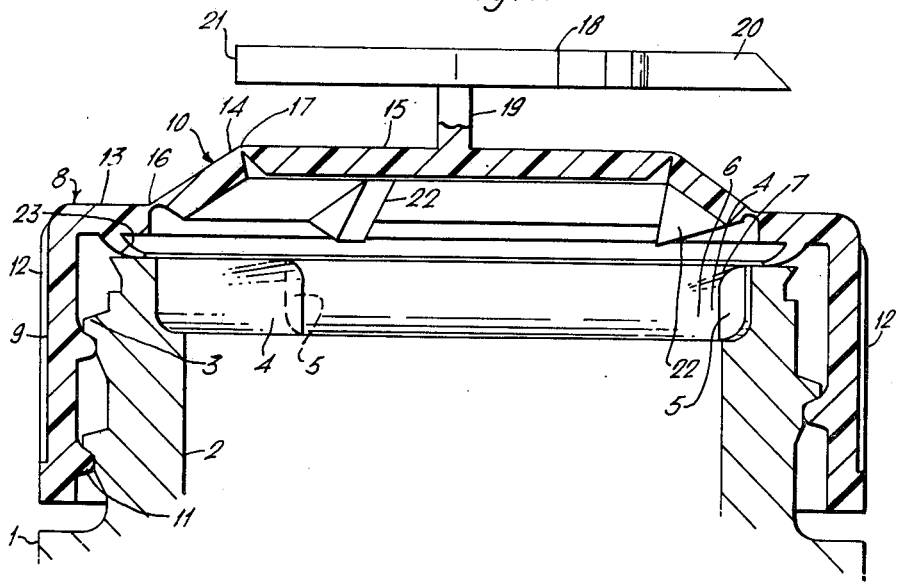
FIG. 1 is a diametric section through the closure cap and through the neck of a container on to which the closure cap is screwed showing the top wall of the closure cap in an upwardly bowed position.
Figure 2:
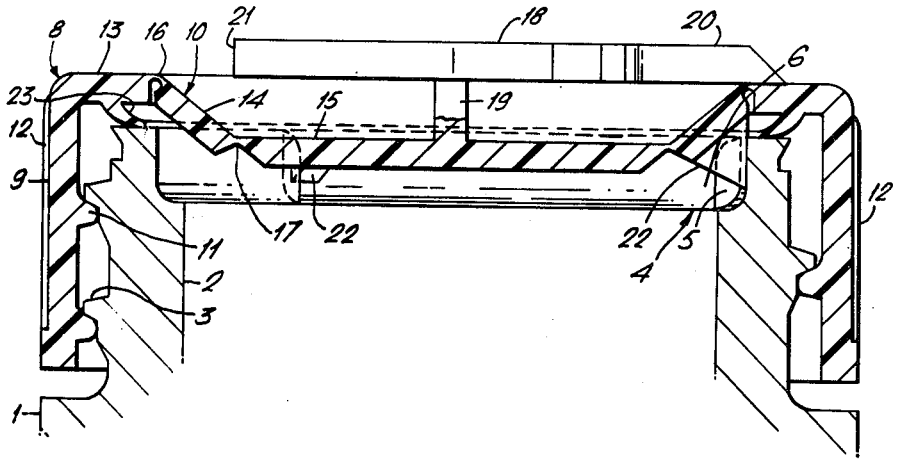
FIG. 2 is a view similar to FIG. 1, but showing the top wall of the closure cap in a downwardly bowed position.
Figure 3:
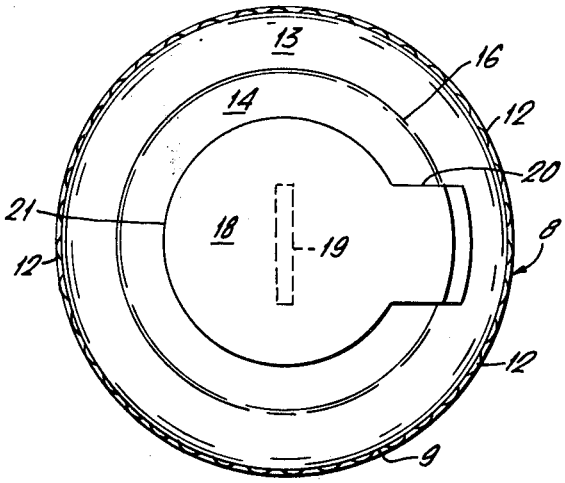
FIG. 3 is a plan view of the closure cap.

As shown in FIGS. 1 and 2, a container in the form of a bottle 1 which is blow-moulded out of plastics material has a neck 2 with an external screw thread 3. Moulded inside the open end of the neck 2 are inward projections in the form of ratchet teeth 4. There are three of these ratchet teeth equally angularly spaced around the inside of the neck and each of the teeth has a steep flank 5 which extends substantially radially of the neck 2, a gently sloping flank 6 and also a sloping upper edge 7.

The neck 2 is closed by a cap 8, which is formed as a single integral injection moulding of polypropylene and this cap comprises a skirt 9 and a top wall 10. The skirt 9 has an internal screw thread 11, by which it is screwed on to the neck 2, and external axially extending ridges 12 to enable it to be gripped manually.

The top wall 10 comprises a horizontal annular peripheral portion 13, an intermediate annular portion 14 and a centre portion 15. The intermediate annular portion 14 is connected to the outer annular portion 13 by an outer annular hinge 16 and the centre portion is connected to the intermediate annular portion 14 by an inner annular hinge 17.

A flange 18 overlies the top wall 10 and is connected to the centre portion 15 by a diametrically extending upright web 19. The flange 18 has a part 20 in the form of a projecting tab which is in contact with the outer annular portion 13 when the top wall is in its downwardly bowed position as shown in FIG. 2 and a further part 21 of the flange has its periphery closely adjacent the outer annular portion 13 so that there is only a very small gap between the periphery and the outer annular hinge 16.

Three lugs 22 project downwards from the underside of the intermediate annular portion 14 and these are equally angularly spaced around the portion 14 in the same way as the ratchet teeth 5 are spaced around the inside of the neck 2. An integrally moulded sealing ring 23 projects downwards from the underside of the outer annular portion 13 and the lugs 22 are so located that when the cap 8 is screwed on to the neck 2 sufficiently tightly for the sealing ring 23 to be pressed firmly against the end of the neck 2, each lug 22 lies in a plane just in front, in a clockwise direction as seen from above, of the steep flank 5 of one of the ratchet teeth 4.

In use, the cap 8 is screwed on to the neck 2 with the top wall 10 in its upwardly bowed position as shown in FIG. 1 of the drawings. With the top wall 10 in this position, the lugs 22 are clear of the ratchet teeth 4 so that the cap can be screwed on without being impeded in any way. When the sealing ring 23 is pressed tightly enough against the end surface of the neck 2 to seal the bottle 1, the flange 18 is pressed downwards so that the hinges 16 and 17 are flexed and the top wall 10 is snapped into its downwardly bowed position as shown in FIG. 2 of the drawings. This causes the intermediate annular portion 14 to move from the upwardly and radially inwardly inclined position shown in FIG. 1 to the downwardly and radially inwardly inclined position shown in FIG. 2 and causes the lugs 22 to move downwards and radially outwards so that one of the lugs 22 lies directly in front of the steep flank 5 of each of the ratchet teeth 4.

If any attempt is made to unscrew the cap 8 from the bottom 1 while the top wall 10 is in its downwardly bowed position, the three lugs 22 come into contact with the flanks 5 of the teeth 4 after the cap has been unscrewed through only a very small angle and this prevents any further unscrewing of the cap and thus prevents the cap from being removed.

Figure 4:
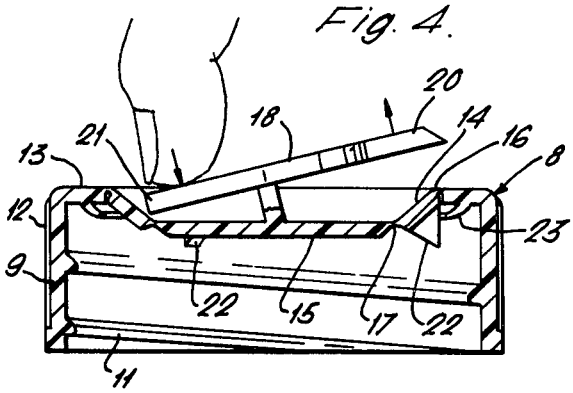
FIGS. 4 and 5 are somewhat diagrammatic diametric sections showing the closure cap in the course of movement of its top wall from its downwardly bowed position to its upwardly bowed position.
Figure 5:
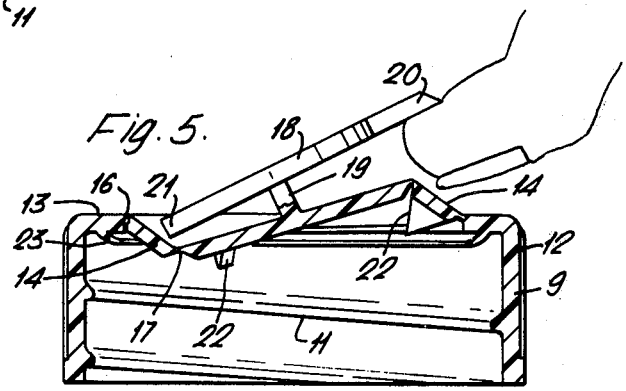

In order to unscrew the cap 8 fully from the neck 2, it is necessary first to move the top wall 10 into its upwardly bowed position as shown in FIG. 1 of the drawings to move the lugs 22 clear of the ratchet teeth 4. To do this, an upward force must be applied to the flange 18. Owing to the small gap between the part 21 of the flange 18 and the outer annular hinge 16, it is impossible for a child to insert its fingers or even its teeth if the cap is pushed into its mouth under the flange 18 to apply an upward force. What is necessary is to apply pressure to a part of the flange 18 diametrically opposite the part 20 and this bends the web 19, which is resilient and flexible and so tilts the flange 18 and raises the part 20 clear of the outer annular portion 13 (FIG. 4). It is then possible to push a finger under the part 20 of the flange 18 as shown in FIG. 5 of the drawings and upward pressure of the finger on the part 20 of the flange causes the top wall 10 to distort into the shape shown in FIG. 5. The finger can then be moved around the underside of the edge of the flange 18 and so snap the left-hand side of the top wall 10 upwards so that the top wall assumes its upwardly bowed position as shown in FIG. 1. The cap 8 can then be unscrewed in the normal manner.

The procedure just described with reference to FIGS. 4 and 5 of the drawings is however beyond the capability of a young child either intentionally or inadvertently and in consequence the cap is highly resistant to opening by such a young child.

The cap does, however, have the further advantage over some other forms of child-resistant closure caps that the top wall 14 may be kept in its upwardly bowed position when the cap is used on a bottle in a home with no young children and then the cap may be screwed on to and unscrewed from the bottle in the normal manner without the nuisance of an adult having to go through the procedure which makes the cap child-resistant.

Owing to the formation of the inward projections in the neck 2 as ratchet teeth 5 each with an upwardly sloping edge 7, no damage is caused to the cap if this is inadvertently screwed on to the bottle with its top wall 14 in its downwardly bowed position and in consequence with the lugs 22 in their downwardly and radially outwardly moved positions. If this is done, the lugs 22 will come into contact with the ratchet teeth 4 as the cap 8 is screwed on and the first contact of the lugs 22 will be with the sloping edges 7 of the flanks 6.

The upward force applied to the lugs 22 by the upwardly sloping edges 7 of the ratchet teeth will either deflect the lugs upwards to some extent so that they ride over the teeth 4 as screwing up of the cap proceeds, or alternatively the upward force on the lugs will snap the top wall 10 into its upwardly bowed position. Upward deflection of the lugs 22 is permitted by the flexibility and resilience of the intermediate annular portion 14 of the top wall on which the lugs are carried.

I claim:

1. In a safety closure cap for fitting to an externally screw-threaded neck or side wall of a container to close the container, said cap comprising a single integral injection moulding of thermoplastic plastics material, said moulding comprising an annular skirt, an internal screw thread in said skirt for screwing on to said neck or side wall, a top wall which closes the top of said skirt, a locking part and engaging means on said locking part, said locking part being movable upwardly and downwardly between a lower position in which said engaging means engages with projections on said container to prevent unscrewing of said cap from said container and an upper position in which said engaging means are clear of said projections to permit unscrewing of said cap, the improvement wherein said top wall is bowed and forms said locking part, said engaging means extend downwards from a peripheral portion of said top wall for engagement with said projections which extend inwardly internally of said neck or side wall, and means is provided on the upper face of said top wall enabling an upward or downward force to be applied selectively to said top wall, said top wall being movable with a snap action by the application of said downward force into a downwardly bowed position in which said engaging means engage with said projections to prevent unscrewing of said cap from said container and being movable by the application of said upward force into an upwardly bowed position in which said engaging means are clear of said projections to allow unscrewing of said cap from said container.

2. A closure cap as claimed in claim 1, wherein said top wall includes two concentric annular hinges, said hinges being constituted by thin sections of said resilient plastics material.

3. A closure cap as claimed in claim 2, wherein said top wall comprises a horizontal annular peripheral portion, a further annular portion within said peripheral portion, and a centre portion within said further annular portion, said peripheral portion being connected to said further annular portion by one of said two concentric annular hinges and said further annular portion being connected to said centre portion by a second of said two concentric annular hinges.

4. A closure cap as claimed in claim 3, wherein said means provided on said upper face of said top wall comprises outwardly projecting flange means and web means connecting said flange means to said centre portion, part of said flange means extending closely adjacent said annular peripheral portion and a remaining part of said flange means being in contact with said annular peripheral portion when said top wall is in said downwardly bowed position.

5. A closure cap as claimed in claim 4, in which said web means is resilient and flexible, whereby downward pressure on said part of said flange means tilts said flange to move said remaining part away from said annular peripheral portion to enable a finger to be inserted under said remaining part to lift said top wall into said upwardly bowed position.

6. A closure cap as claimed in claim 1, wherein said engaging means on said top wall comprises a plurality of circumferentially spaced lugs, said lugs being movable downwards and radially outwards as said top wall is moved from said upwardly bowed position to said downwardly bowed position.

7. A closure cap as claimed in claim 1, further comprising a sealing ring moulded integrally with said top wall, said sealing ring being adapted to engage sealingly with an end surface of said neck of said side wall of said container when said cap is screwed on to said container.

8. A closure cap as claimed in claim 1, in which said plastics material is polypropylene.

9. A closure cap as claimed in claim 1, in combination with a container, said container including a neck or side wall, an external screw thread on said neck or side wall, said closure cap being screwed on to said external screw thread, and a plurality of inward projections projecting radially inwardly from said neck or side wall, said engaging means being engageable with said projections when said top wall is in said downwardly bowed position.

10. The combination as claimed in claim 9, wherein said inward projections are in the form of ratchet teeth to enable said cap to be screwed on to said container while said top wall is in said downwardly bowed position.

* * * * *